United States Patent [19]

Pelura

[11] 4,400,836

[45] Aug. 30, 1983

[54] METHOD FOR FITTING BED SHEETS

[75] Inventor: Carme D. Pelura, Pennsville, N.J.

[73] Assignee: Neat Nap, Incorporated, Pennsville, N.J.

[21] Appl. No.: 288,775

[22] Filed: Jul. 31, 1981

[51] Int. Cl.[3] ..... A44B 21/00; A47G 9/04

[52] U.S. Cl. ..... 5/498; 24/72.5

[58] Field of Search ..... 5/496, 498, 508; 297/219; 24/72.5

[56] References Cited

U.S. PATENT DOCUMENTS

| | | | |
|---|---|---|---|
| 2,931,055 | 4/1960 | Sostrin | 5/496 |
| 3,092,848 | 6/1963 | Gronvold | 24/72.5 |
| 3,962,757 | 6/1976 | Gedney | 24/72.5 |
| 4,276,667 | 7/1981 | Osbourne | 5/498 |

FOREIGN PATENT DOCUMENTS

| | | | |
|---|---|---|---|
| 202300 | 2/1959 | Austria | 5/498 |
| 2228156 | 12/1973 | Fed. Rep. of Germany | 24/72.5 |

*Primary Examiner*—Alexander Grosz

*Attorney, Agent, or Firm*—Barnes & Thornburg

[57] ABSTRACT

A method for using a device for facilitating the covering of a furniture piece, which includes a flat plate which is sized and shaped to fit between the cushion and cushion supports of a chair or couch, or between a mattress and a mattress support of a bed. The flat plate contains a plurality of parallel rectangular slots through which a corner of the furniture covering is passed for securing the furniture covering to the plate. When placed between the mattress and mattress support or cushion and cushion support of a furniture piece, the weight of the mattress or cushion serves to hold the plate in place, which serves to maintain the position of the sheet upon the bed.

12 Claims, 6 Drawing Figures

METHOD FOR FITTING BED SHEETS

This invention relates to bed sheets, and particularly to an improvement over the so-called "contour" or "fitted" sheet.

The process of placing a set of sheets on the top side of the mattress and tucking the edges of the sheet between the mattress and a mattress support is an old and well-known method of creating a suitable and aesthetically pleasing sleeping surface on a bed. Although this process is practiced daily by most people, few devices have been made to facilitate the process. The most notable advance to date is probably the contoured sheet.

Generally, bed sheets come in two varieties, flat and contoured. A flat sheet is usually little more than a rectangular piece of linen or other material, hemmed on two sides, which is sized and shaped so as to extend over the top and sides of the mattress, with enough overhang to permit the edges of the sheet to be tucked between the mattress and the mattress support. A contoured sheet, on the other hand, contains a strip of elastic around the outer edges of the sheet so as to permit the sheet to fit snugly around the four corners of the mattress or, in the case of a circular bed, around the circumference of the mattress.

Generally, the use of contour sheets is restricted to use as a bottom sheet, requiring a flat sheet to be used for the top sheet. Contour sheets also suffer the disadvantage of being generally more expensive than flat sheets and also more difficult to fold neatly when removed from a clothes dryer. Further, in order to operate effectively, a contour sheet must be sized to fit the mattress upon which it is to be placed. If the contour sheet is too small, it becomes very difficult to fit onto the mattress. On the other hand, if the contour sheet is too large, it may work its way off the mattress.

One attempt to overcome the problems of contoured sheets is found in Calabro U.S. Pat. No. 2,459,497. The Calabro patent discloses a device having a base which is intended to be placed between a mattress and a mattress support. Connecting ribbons are attached to the base and support conventional spring clips which are clipped onto the bed sheet or blanket near the foot of the bed to hold the sheet or blanket in place. The present invention represents a substantial advance over the Calabro device in that the present invention does away with a need for ribbons and spring clips. Further, the device of the present invention is designed for use with sheets which are sized to drape over the mattress and hang lower than the bottom of the mattress, whereas the Calabro device seems better suited for sheets which extend only partway down the side of the mattress. This enables the present invention to be utilized with the types of sheets which are standard within the textile industry today. Attention is also directed to Leader U.S. Pat. No. 2,543,552; Kay U.S. Pat. No. 2,567,072; and Bini U.S. Pat. No. 3,749,441, which disclose devices adapted for use with mattresses, pillows, and the like.

It is an object of this invention to provide a durable and lasting device which will facilitate the process of making a bed by contouring flat sheets to fit the mattress upon which they are placed, to hold the sheets firmly in place, and to eliminate the problems caused by contour sheets which are incorrectly sized for the mattress upon which they are placed.

A further object of this invention is to provide a device which is easy to apply to and remove from a sheet, which won't damage the sheet and which can be used with any flat sheet large enough to cover the mattress, and overhang the sides of the mattress.

It is also an object of this invention to provide a device which will enable the user to purchase relatively inexpensive flat sheets rather than relatively more expensive contoured sheets.

According to the present invention, a device for facilitating the making of beds comprises a flat plate which is sized and shaped to fit between a mattress and a mattress support (e.g., box springs or open springs) of a bed. The flat plate includes a plurality of generally parallel rectangular slots through which the corner of a bedsheet is passed. By passing the corner of the bedsheet through the slots and placing the plate between the mattress and the mattress support, a flat sheet takes on some of the characteristics of a contoured sheet. Like a contour sheet, the device facilitates the making of a bed, and serves to secure the sheet in place.

Various other features and advantages of the present invention will become apparent in view of the following detailed description, which should be considered in conjunction with the accompaning drawings in which.

Figure 1:
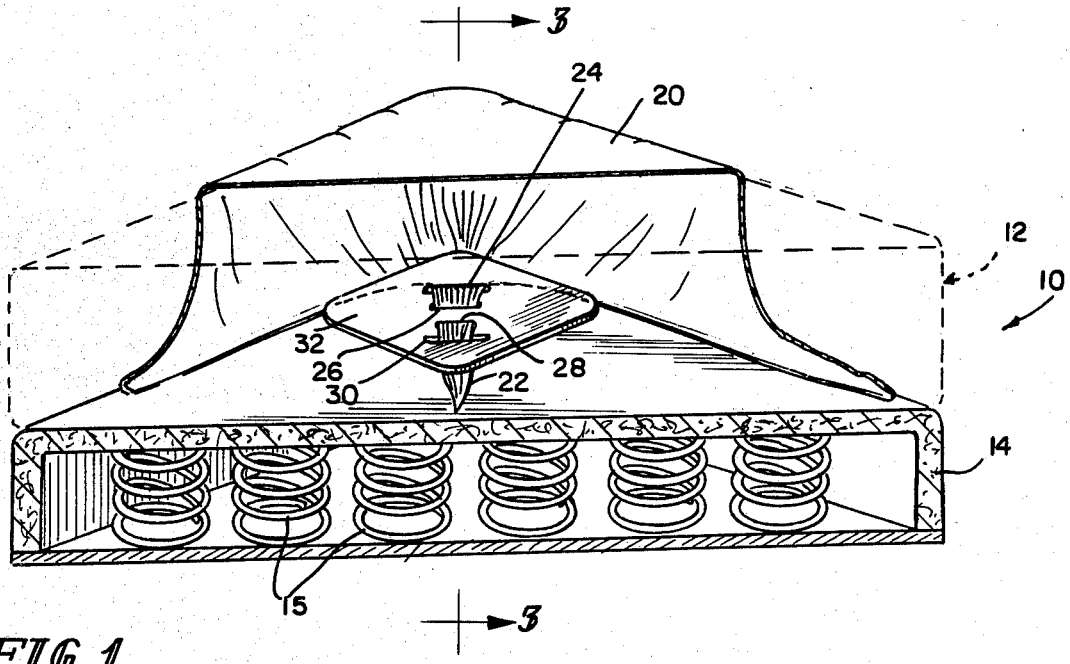
FIG. 1 is a perspective view of one end of a bed, with portions broken away, showing the invention in use.
Figure 3:
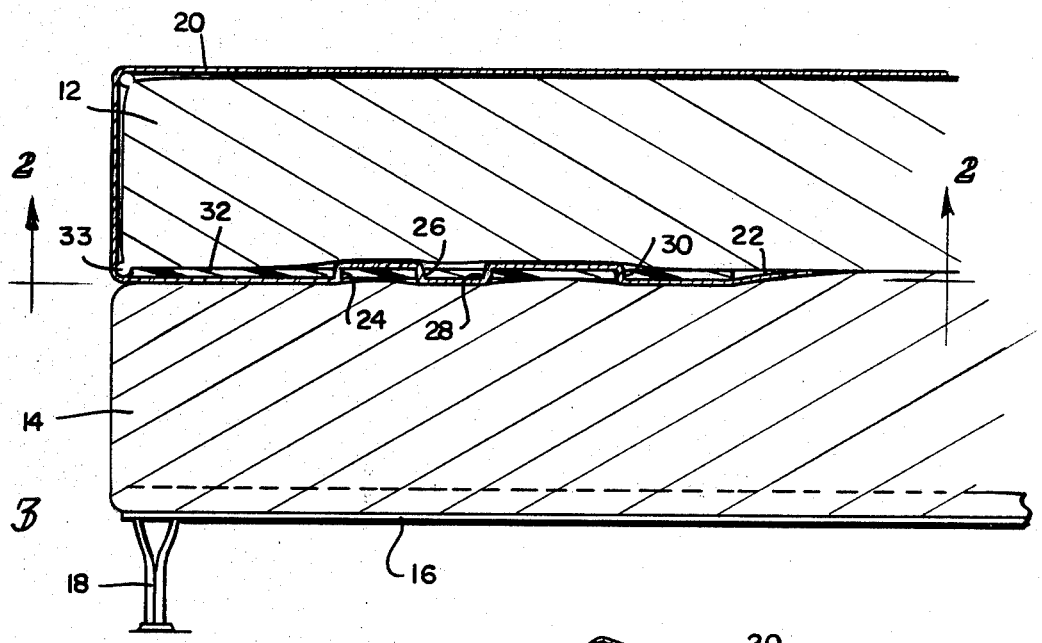
FIG. 3 is a side elevational sectional view of a bed, taken generally along section lines 3—3 of FIG. 1.

Referring now to FIG. 1, a bed 10 includes a mattress 12 which rests upon a mattress support 14. Typically, the mattress support 14 will take the form of a box spring-type mattress support containing coil springs 15. It can be appreciated, however, that the mattress support 14 can also take the form of an open spring frame, or in the case of a water bed, a base. In FIG. 3, the mattress 12 and mattress support 14 are supported above the ground by a frame 16 having legs 18. Covering the mattress 12 is a sheet 20 which is sized and shaped to cover the top and sides of the mattress 12 and to contain enough extra material to enable the user to tuck the edges of the sheet 20 between the mattress 12 and the mattress support 14. A corner 22 of the sheet 20 is drawn through a series of slots 24, 26, 28, 30 provided in the plate 32 of the present invention. The plate 32 is placed between the mattress 12 and the mattress support 14 and is held in place by the weight of the mattress 12.

Figure 2:
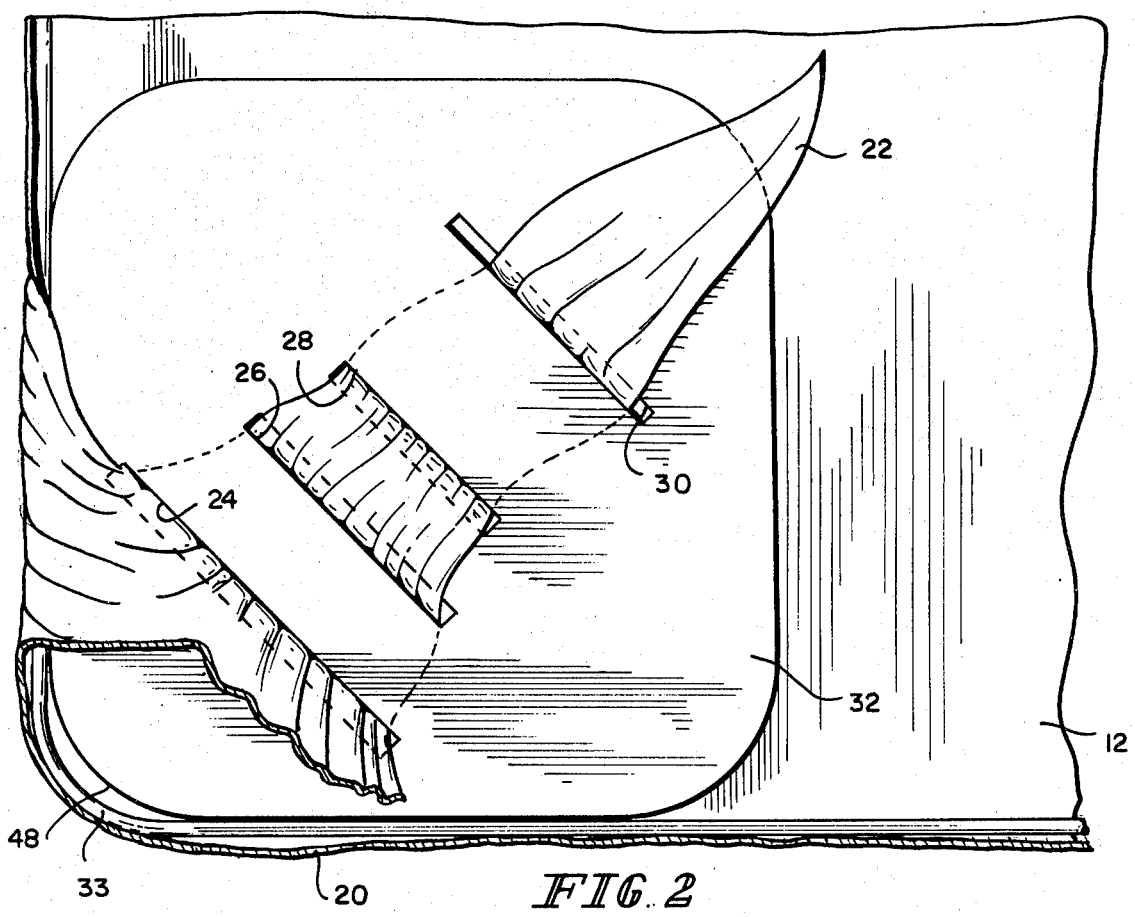
FIG. 2 is a bottom view of the invention.

Referring now to FIG. 2, plate 32 is thin and flat. In the illustrated embodiment, the plate 32 is approximately ⅛ inch (0.3 cm) thick. The plate may be of any shape, length, or width, so long as it is large enough to accommodate slots 24, 26, 28, 30, but small enough so as not to interfere with the operation of other plates placed on other corners of the sheet. In the illustrated embodiment, the first slot 24 is the longest, being approximately 3½ inches (8.9 cm) long by ¼ inch (0.64 cm) wide. The second slot is shorter and narrower than the first slot, being approximately 2½ inches (6.4 cm) long by 3/16 inch (0.47 cm) wide. The third slot 28 is shorter than the second slot, but just as wide, being approximately 2 inches (5.1 cm) long by 3/16 inch (0.47 cm) wide. The fourth slot is approximately the same size as the second slot, approximately 2½ inches (6.4 cm) long by 3/16 inch (0.47 cm) wide. It will be appreciated from FIG. 2 that the slots 24, 26, 28 are generally parallel to each other and are arranged in series.

Figure 5:
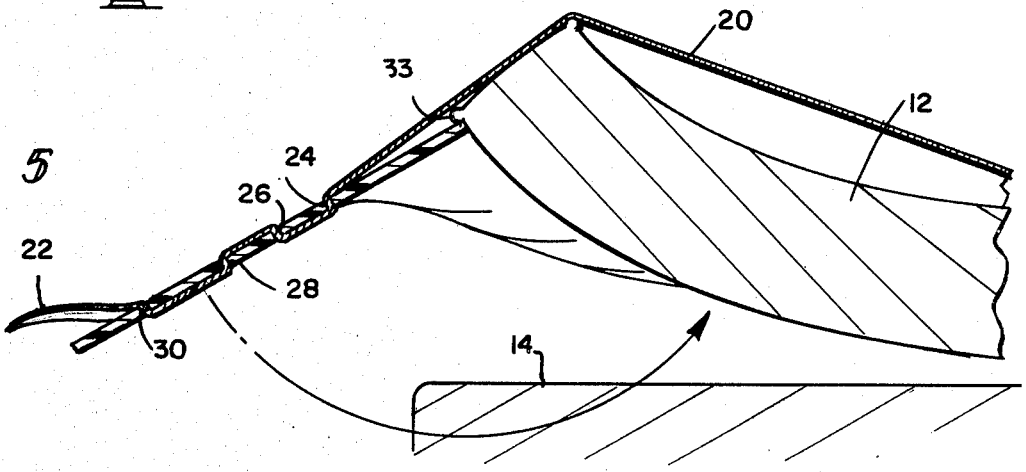
FIG. 5 is a view similar to FIG. 3, illustrating the invention in the process of being placed between a mattress and a mattress support.

The operation of device 32 can best be understood by reference to FIGS. 1, 3, and 5. The device 32 is held flat, face up with slot 24 farthest from the user and closest to the corner of the mattress. The corner 22 of a sheet 20 is grasped firmly and is drawn down through first slot 24, threaded up through second slot 26, down through third slot 28, and then up through fourth slot 30. The user then flips the plate 32 over, tucking it between the mattress 12 and mattress support 14. The weight of the mattress 12 serves to hold the plate in place. It should be noted that in this configuration, the corner 48 of the plate 32 will serve to smoothly fit or contour the sheet around the corner of the mattress.

Referring now to FIG. 5, the device 32 can be used to gain a mechanical advantage when tucking a corner 22 of a sheet 20 between a mattress 12 and mattress support 14, and especially when used on the final corner of the sheet 20 which is tucked. The mechanical advantage gained by placing the corner of the plate 32 against the bottom or bead 33 of the mattress 12 will serve to tighten the sheet 20 upon the mattress 12 and serve to provide an aesthetically pleasing, substantially wrinkle-free sleeping surface.

The plate 32 is designed so as to permit the plate 32 to engage the bead 33 surrounding the bottom surface of the mattress 12. When so engaged, the bead 32 will help prevent the plate 32 from slipping out from between the mattress 12 and the mattress support 14. Additionally, the roughened surface provided by the engagement of the part of the sheet 20 which is drawn through the plate 32 with the bottom surface of the mattress 12 and the top surface of the mattress support 14 will help prevent the plate 32 from slipping from between the mattress 12 and mattress support 14.

Figure 6:
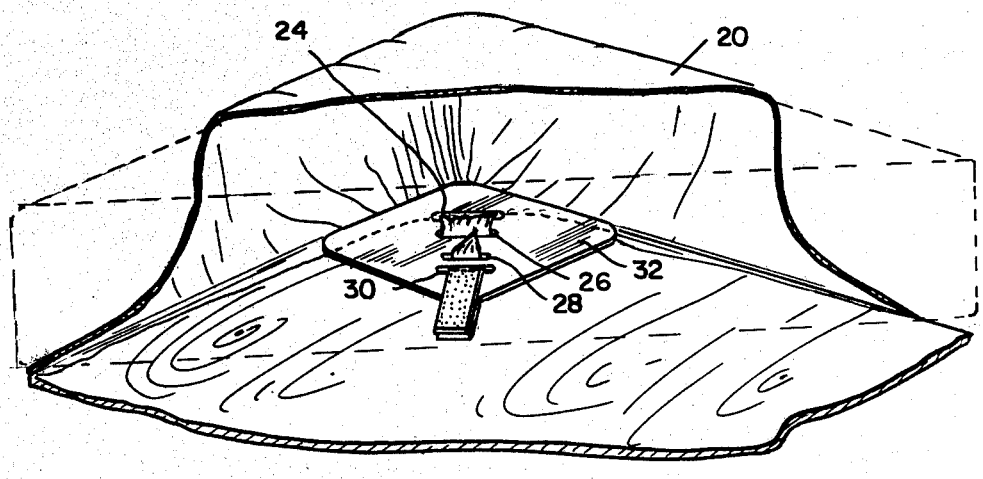
FIG. 6 is a view similar to FIG. 1, showing an alternative application of the invention to a bed.

An alternative use of slot 30 is illustrated in FIG. 6. In FIG. 6, a strip of foam rubber or a similar material is inserted through slot 30 to provide greater traction between the plate 32 and a smooth base, such as a platform base of a bed. When slot 30 accommodates this traction-providing strip, the sheet 20 is pulled through only slots 24, 26, and 28.

Figure 4:
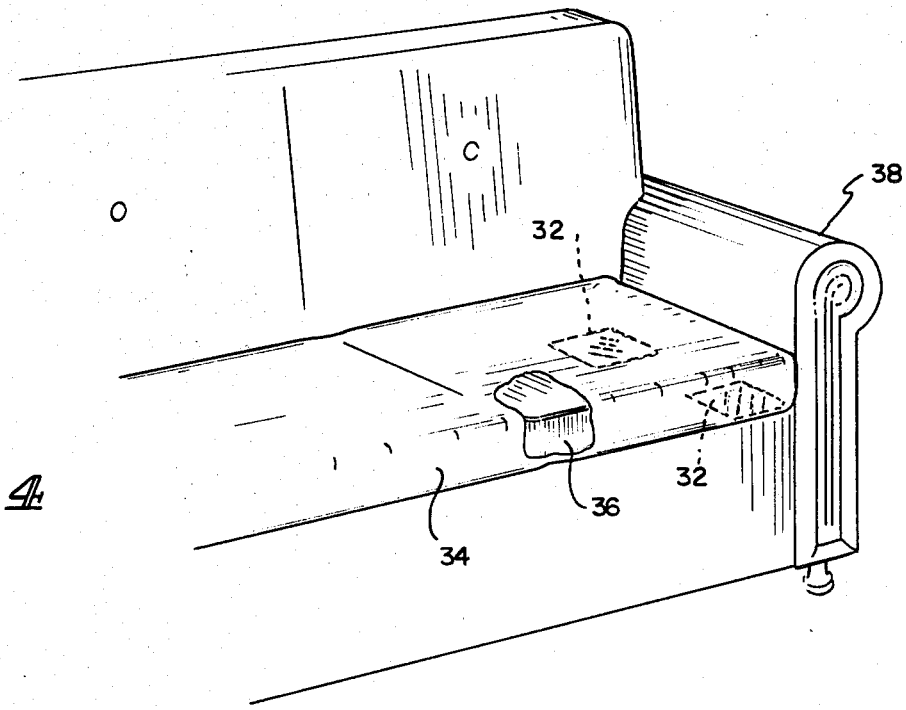
FIG. 4 is a perspective view of a couch containing a cushion covering showing the invention in use.

Another use of the invention is shown in FIG. 4, wherein the invention is used to hold a cover 34 such as a slip cover onto the cushions 36 of a sofa 38. It is envisioned that pet owners who place covers over their couches and other furniture to prevent their pets from soiling the couch or other furniture will appreciate this adaptation of the invention.

What is claimed is:

1. A method for facilitating the covering of a furniture piece, providing a flat plate which is sufficiently rigid to serve as a lever and sized and shaped to fit between a mattress or cushion and a mattress or cushion support of a furniture piece, said flat plate including a slot through which a corner of a furniture covering is passed for securing said furniture covering to said plate, and using the plate as a lever arm for enabling a user to apply a moment to the plate to gain a mechanical advantage when placing a portion of the furniture covering between the mattress or cushion and the mattress or cushion support.

2. The method of claim 1 wherein the slot is rectangular.

3. The method of claim 1 wherein the furniture piece is a bed and the furniture covering is a sheet.

4. The method of claim 1 wherein the furniture piece is a couch or chair.

5. The method of claim 1 wherein the flat plate is generally rectangular and includes smoothly rounded corners.

6. The method of claim 1, wherein the plate includes a plurality of slots, and the furniture cover is drawn successively through the slots.

7. The method of claim 6, wherein the slots are generally parallel, and the plate includes generally rounded corners.

8. The method of claim 1 wherein the moment is applied to pivot the plate about a pivot formed by the contact of the edge of the plate with the surface of the mattress or cushion.

9. A method for facilitating the covering of a furniture piece, comprising using a flat plate which is sufficiently rigid to serve as a lever and sized and shaped to fit between a mattress or cushion and a mattress or cushion support of a furniture piece, said flat plate including a plurality of substantially parallel slots, passing a corner of a furniture covering successively through the slots for securing said furniture covering to said plate, said plate further containing a curved corner portion for contouring the furniture covering around a corner of the mattress or cushion, placing an edge of the plate against a surface of the mattress or cushion, and applying a moment to the plate to gain a mechanical advantage when placing a portion of the furniture covering between the mattress or cushion and the mattress or cushion support.

10. The method of claim 8 wherein the plate is rigid and sized so as to engage a bead surrounding a lower surface of the mattress.

11. A method of fitting a furniture covering between a mattress or cushion and a mattress or cushion support comprising the steps of placing the furniture covering over the mattress or cushion, providing a device for facilitating the covering of the mattress or cushion, the device comprising a substantially rigid, flat plate having a plurality of slots, drawing a corner of the furniture covering successively through the plurality of slots, placing an edge of the plate against a surface of the mattress or cushion to be covered, rotating the plate about the pivot formed by the intersection of the edge of the plate and the surface of the mattress or cushion, and engageably placing the plate between the mattress or cushion and mattress or cushion support.

12. A method for facilitating the covering of a furniture piece comprising using a device consisting essentially of a flat, generally rectangular plate having rounded corners the plate being sufficiently rigid to serve as a lever and, including a plurality of substantially rectangular, substantially parallel slots passing a corner of a furniture covering through the slots for securing said furniture covering to said plate, and applying a moment to the plate to gain a mechanical advantage when placing a portion of the furniture covering between the mattress or cushion and the mattress or cushion support.

* * * * *